United States Patent [19]

Morgan

[11] 3,983,830

[45] Oct. 5, 1976

[54] METHOD AND APPARATUS FOR ASSEMBLY OF A MODULAR BARGE

[75] Inventor: George W. Morgan, Dallas, Tex.

[73] Assignee: Sun Oil Company (Delaware), Dallas, Tex.

[22] Filed: June 6, 1975

[21] Appl. No.: 584,325

[52] U.S. Cl. ..... 114/77 R; 114/.5 F; 114/40

[51] Int. Cl.[2] ..... B63B 3/08

[58] Field of Search ..... 114/.5 F, 77, 65, 28, 114/30, 40–43, 235 R, 235 A; 29/433, 241, 464, 469; 52/227, 229

[56] References Cited

UNITED STATES PATENTS 3,799,100 3/1974 Marriner ..... 114/.5 F X

FOREIGN PATENTS OR APPLICATIONS 2,000,757 1/1970 Germany ..... 114/.5 F

*Primary Examiner*—Stephen G. Kunin
*Assistant Examiner*—Sherman D. Basinger
*Attorney, Agent, or Firm*—Donald R. Johnson; J. Edward Hess

[57] ABSTRACT

A method of and apparatus for the construction of a modular barge is provided wherein individual floatation modules are assembled and secured one to another by the positioning and linking of separable alignment pins therebetween and the threading of tensioning cables therethrough. Each alignment pin has a generally elliptoid shape and an axial cable receiving bore therethrough. Each flotation module is formed with a plurality of sockets complementally shaped for the alignment pins and linked in pairs by transversely extending passages therethrough and spaced along adjacent side walls of the modules to be in registry with one another. With the modules in a spaced array, assembly cables are threaded through certain ones of the module passages. First ends of the cables are anchored to perimeter modules and the opposite ends are tensioned to draw the modules and alignment pins together, wherein the configuration of the alignment pins then facilitates alignment and coupling. A lock provided in each socket and alignment pin secure that coupled relationship. Tensioning cables threaded serially through certain other ones of the module passages and alignment pins provide structural rigidity for the barge through the post tensioning thereof.

4 Claims, 9 Drawing Figures

METHOD AND APPARATUS FOR ASSEMBLY OF A MODULAR BARGE

BACKGROUND OF THE INVENTION

1. Field of the Invention

The present invention relates to barges and, more particularly, to barges comprised of a plurality of a modular float sections, assembled by drawing them together from a spaced array, and releasably secured one to the other through separable alignment pins and post tensioning cables.

2. Technical Considerations and Prior Art

The provision of flotation platforms and barges which may be constructed in modular form, greatly facilitates activities such as drilling for oil in offshore areas. These flotation units are generally comprised of a plurality of smaller flotation elements, transportable to a select assembly site for securement together through a substantially rigid structural network. The float elements, or modules, are usually linked by connecting adjacent structural points of contiguous ones. Such a manner of construction forms an arrangement which is suitably rigid for the support of drilling rigs in ocean areas.

The fastening means for each float at the structural interconnect has formed the basis for many improvements in modular barge construction. For example, certain latch configurations have been shown to freeze up due to temperature, corrosion and/or build up of marine life. It has been found that such modular barges can be readily assembled through the usage of mating male-female elements in the form of pin-sockets correspondingly formed in each modular section. Spacing of these male-female fasteners vertically about the sides of the modular sections has been shown to provide adequate structural integrity and a variety of assembly advantages.

Application of male-female elements for flotation bodies is, however, not limited to modular barges or platforms. Modular constructions of ships and related powered vessels have utilized such fastening means to removably connect two complemental sections in abutting relation, capable of detachment if one should become damaged. In such constructions, both separable and integrated coupling elements have been used to connect the abutting sections for quick disconnect. Separable elements have included tubular, tapered sections. Integrated elements have included fixed and extendible locking projections adapted for engagement with the mating module. Generally, however, alignment and assembly upon ice and/or open seas has not been a design criteria in this area.

Male-female connections on modular platforms adapted for oil well drilling have generally utilized the integrated coupling elements, with design emphasis on their alignment and assembly in water. For example, one variety of platform barge utilizes fixed connecting pins spaced around the module in vertical pairs. Such structures have been shown to facilitate assembly at sea while exhibiting sufficient structural integrity. These constructions although substantially rigid, are subject to high stress concentrations in the fasteners and ultimate yielding when subjected to various loading forces as is common by wind and waves or when assembling upon ice. Such supporting surfaces often produce twisting and turning forces and relative interaction between adjacent modules during and after assembly. Such conditions aggravate the already difficult task of uniting the plurality of floating elements as well as keeping them intact.

When modular elements are assembled upon ice packs, subject to fracture and breakthrough, it has been shown that fastening projections integrally formed in a first module, regardless of taper and size, can hinder rather than aid the overall assembly process. For example, fastening projections formed as tubular extensions engageable in female recesses of the adjacent module, are subject to deformation when one module rises or falls in relation to the other. Once distorted a complete module may be rendered in-operative for assembly as long as the fastening projection is not engageable. Once latched together, if such a rigid projection becomes deformed, disengagement may be dangerously hindered.

The assembly of modular platforms upon ice and on rough seas is further aggravated by the difficulty in positioning the heavy modules together and attaining the necessary degree of alignment therebetween for fastening. Heavy cranes and equipment are often used to accomplish this. When tubular male projections are employed, they be partially tapered to aid in the initial union with the adjacent recess. However, even when the projection is tapered the problem of moving the modules together so as to not damage the appendages still remains. When the assembly location is thin ice or open seas, this aspect becomes the dominant assembly criteria of module design.

Further complicating the design considerations for modular barges adapted for ice regions, such as North Sea areas, is the problem of the assembled barge freezing in the ice. The problem is of course recognized when disassembly of a barge floating in an ice pack is attempted. The peripheral modules can often be broken free from the ice simply by unloading the barge and allowing the bouyant force of the water to raise it. However, standard male pin connections require relative lateral movement between modules for disassembly, which is generally blocked by the abutting ice. Such conditions may thus necessitate special disassembly apparatus.

It has been shown that flexibility must be afforded in the fastening means of the adjacent modules for both assembly and disassembly. Furthermore, means for the drawing together of the modules one to the other upon uneven, fragile or undulating surfaces, wherein alignment may be readily accommodated, has been shown to be necessary. Such conditions render the usage of fixed, tubular projections less than an optimal design. Furthermore, such projections create hazards in transportation occuring during the necessary transport of the individual modules by airplane.

It would be an advantage therefore, to avoid the problems of prior art modular barge structures of the type which may be handled and transported conveniently and safely by airplane, by providing them with separable alignment and coupling elements and related apparatus facilitating the linking, alignment and securement of the array of flotation modules into a structure which facilitates assembly and disassembly upon rough seas or ice and provides means for shear stress and strain relief between adjacent modules without the deformation and damage thereof.

SUMMARY OF THE INVENTION

One object of the present invention is to provide a new and improved method of assembling and disassembling float sections comprising a modular barge.

Another object of the present invention to provide new and improved apparatus for the assembly and disassembly of the flotation elements of a modular barge.

A further object of the present invention is to provide an alignment and coupling body, separable from each of the flotation modules, for positioning therewith to facilitate the assembly of a modular barge.

Another object of the present invention is to provide a new and improved apparatus for securing a separable alignment pin in a module recess to facilitate assembly and disassembly of the modular barge, and which will afford a means for selectively securing each pin individually to provide for its expeditious removal should it become damaged.

A further object of the present invention is to provide a new and improved means for urging modular barge components together in aligned, abutting relationship upon a rough or weak supporting surface such as ice.

Finally, another object of the present invention is to provide a new and improved fastening means for retaining modular barge flotation components in fixed relative positioning for structural integrity and carrying the necessary shear forces imparted by an undulating sea or ice therebeneath.

A modular barge in accordance with the principles of the present invention may include flotation modules, each having an inwardly tapering socket formed along a sidewall thereof and positioned to be in registry with a socket of an adjacent module. An alignment body having a generally elliptoid shape, complementary to the sockets for loose fitting mating engagement therewith, is provided for the assembly and connection of the modules.

The alignment body is formed with an axial bore of tubular construction extending therethrough for positioning in registry with a central aperture formed in each socket. Each alignment body further has a recess circumferentially formed around each tapering end portion for engaging a locking member positioned in the socket. The engagement of the locking member of the socket with the alignment body provides for secured positioning of the modules one to the other.

A method of assembling the modules of a modular barge with a tensioning means in accordance with the principles of the present invention includes the steps of arranging the barge modules in a spaced array, threadably linking the modules, anchoring a first end of the linkage in perimeter modules, connecting a second end of the linkage to the tensioning means, and drawing the modules one to another in the desired configuration. When assemblying a plurality of modules, the perimeter ones are drawn to the center of the array, maintaining a predetermined assemblage location and minimizing the number of modules being moved at any one time.

A method of securing flotation modules one against the other in a predetermined array configuration in accordance with the principles of the present invention includes the steps of threadably linking one module to another, tensioning the linkage for pressing together their adjacent side walls, and maintaining the tension by anchoring the ends of the linkage in the perimeter modules. A method of accommodating bending and twisting loads between modules is further provided through structurally supporting the adjacent side walls along opposed areas inwardly of each and effecting uniform contact thereacross by said tensioning.

The alignment body, or pin, comprises a tubular structure formed of suitably strong material in a watertight configuration. The outwardly tapering end portions are in the shape of frustums of cones, positioned back to back to form the body. When this shape is utilized the module sockets form complementary infundibular openings, providing a male/female engagement facilitating wide latitudes of angular misalignment during the assembly and disassembly process without damage to the elements involved.

The module sockets are spaced in vertical pairs around the moodule. Opposite ones in each module are connected by a series of tubular passages, constructed through the modules in a watertight, sealed configuration. The tubular network forms structural trusses in each module as well as providing means for threading linking and tensioning cable therethrough.

Once the modules and alignment bodies are set out in the desired array and threadably linked by assembly cables, the assembly process is effected by utilizing the cables to draw one module to another with a tensioning device such as a winch. Whether on ice or water, alignment of adjacent modules is accommodated by the alignment bodies mating in the contoured sockets. Once fully engaged, a second set of cables is threaded through the modules and alignment bodies serially. This set of cables is rendered taught through a post-tensioning means providing the structural integrity of the array.

Each alignment body has a pair of grooves, each circumscribed about a portion of the frustoconical section, inwardly of its end face. The groove permits the body to engage the module socket in any rotational orientation while providing a recess for engaging a locking means in the form of an eccentric latch or the like in the socket wall. Alignment bodies comprising the male elements of the connection, may thus be selectively positioned in either opposed socket or released thereform as conditions require.

The assembly or disassembly of the structure is possible in adverse weather conditions where heretofore impossible. Where necessary, sections can be released when icebound, through uncoupling of the perimeter modules. These modules are formed with downwardly and inwardly tapering outboard side walls for facilitating their pivotal rotation out of an adjacent ice flow. This outboard slant configuration, when utilized in conjunction with the separable alignment body provision of this invention, provides a necessary function for modular barge application in such environments.

BRIEF DESCRIPTION OF THE DRAWINGS

A complete understanding of the present invention will be obtained from the following detailed description thereof. when read in conjunction with the accompanying drawings wherein.

DETAILED DESCRIPTION

Figure 1:
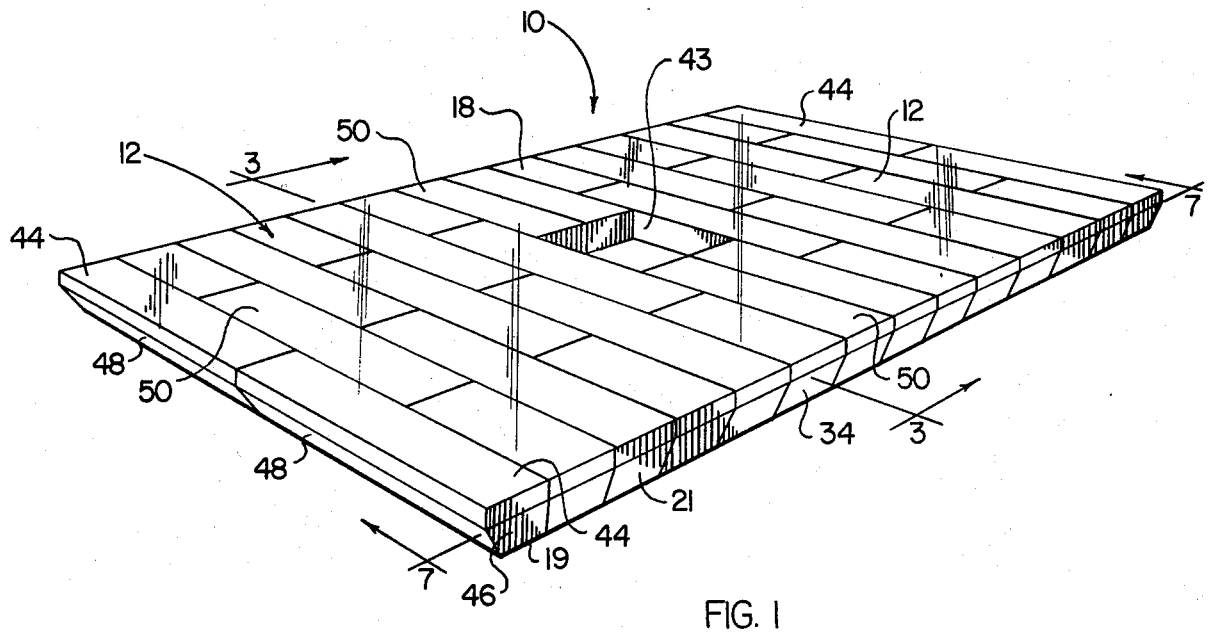
FIG. 1 is a perspective view of one embodiment of a modular barge in accordance with the principles of the present invention.
Figure 2:
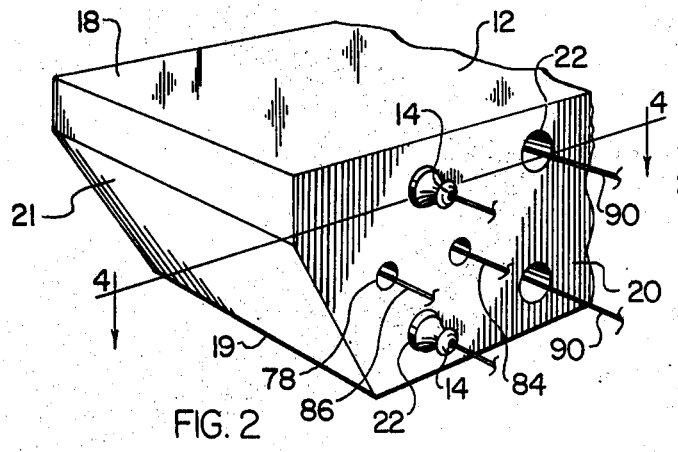
FIG. 2 is an enlarged fragmentary view of a portion of a flotation module comprising the barge of FIG. 1 showing the details of an alignment pin extending therefrom.

Referring to FIGS. 1 and 2, there is shown a modular barge 10 which includes a plurality of floating modules, generally referred to as 12—12, and alignment bodies, or pins 14—14, assembled in an array and linked by elongated filaments in the form of cables threaded therethrough. The modules 12—12 are watertight structures, each having a generally rectangular transverse cross-sectional periphery defining a deck surface 18, a bottom surface 19, and opposite side and end walls generally referred to as 20—20 and 21—21, respectively, joining said deck and bottom surfaces. Each side wall 20 is constructed with a plurality of spaced recesses, or sockets 22—22 therealong for assembly and structural purposes. These elements, in combination, provide a new and improved modular flotation structure and method of assembly thereof, greatly facilitating platform drilling and related operations in offshore regions.

Figure 4:
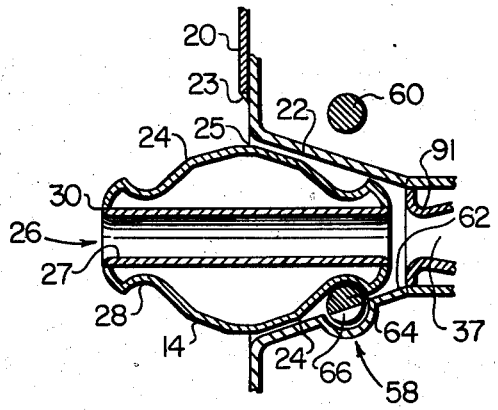
FIG. 4 is an enlarged sectional view of a portion of the module and alignment pin of FIG. 2 taken along the lines 4—4 thereof.

As shown most clearly in FIG. 4, the alignment pin 14 is a unitary structure formed in a generally elliptoid configuration with outwardly tapering end portions of complementary shape and size to the sockets 22 for relatively loose fitting mating engagement therewith. The alignment pin 14 is preferably formed of cast steel or other suitably rigid materials in a tubular, watertight construction. A pair of tapered portions 24—24, generally frustoconical in shape extend outwardly the center portion 25 of the pin 14 to form this elliptoid shape. Such a construction has been shown to be an effective mating configuration for pin-socket engagement providing both structural and functional advantages for the assembly of a barge 10.

The alignment pin 14 further includes a longitudinal passageway 26 formed axially therethrough. Passageway 26 is preferably constructed of a cylindrical pipe 27 which functions as a tubular chord in the pin 14, providing longitudinal rigidity and providing a sleeve for the through positioning of tension members, such as cables used in the barge assembly. The diameter of this sleeve is no larger than that required to facilitate the threading of the required tension members, as discussed in more detail below.

The back-to-back frustoconical configuration of the alignment pin 14 will be shown to facilitate concurrent mating engagement with opposed sockets 22 of adjacent modules 12—12. To further facilitate this assembly, each outwardly tapering portion 24 of the pin 14 includes a necked section 28, of reduced cross-sectional area, inwardly of an alignment pin end face 30. The necked section 28 forms a circumferential recess in the pin 14 for engaging a locking means provided in each socket 22 to secure the pin therein. Because the necked section 28 is circular, the rotational orientation of the pin 14 in the mating socket does not have to be controlled, further facilitating assembly of the barge 10.

Figure 3:
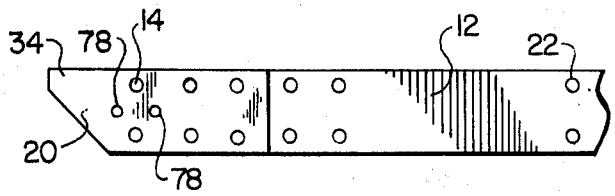
FIG. 3 is an enlarged, perspective, fragmentary view of a module section of the barge of FIG. 1 taken along the lines 3—3 showing the locations of a plurality of alignment pins connected thereto.
Figure 3A:
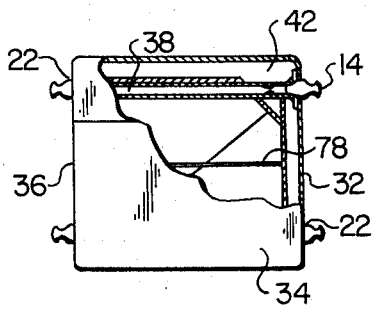
FIG. 3A is an enlarged, sectional, end elevational view of the module of FIG. 3.

As shown in FIG. 3, a plurality of sockets 22–22 are provided across the side wall 20 of a module 12. The pattern formed is derivative of the overall barge configuration. Preferably the sockets 22—22 are spaced in vertical pairs, along each wall 20, and in opposed relationship with those of the opposite wall 20 of that module 12. Specifically, a socket 22 on a wall 32 of a single central module 34, as shown in FIG. 3A, is directly opposite a socket 22 on an opposite wall 36 of the module 34 and is linearly connected by a tubular truss chord 38 extending therebetween. Each socket 22 thus forms an end of a truss 38 providing a structural interconnect therefor.

Figure 7:
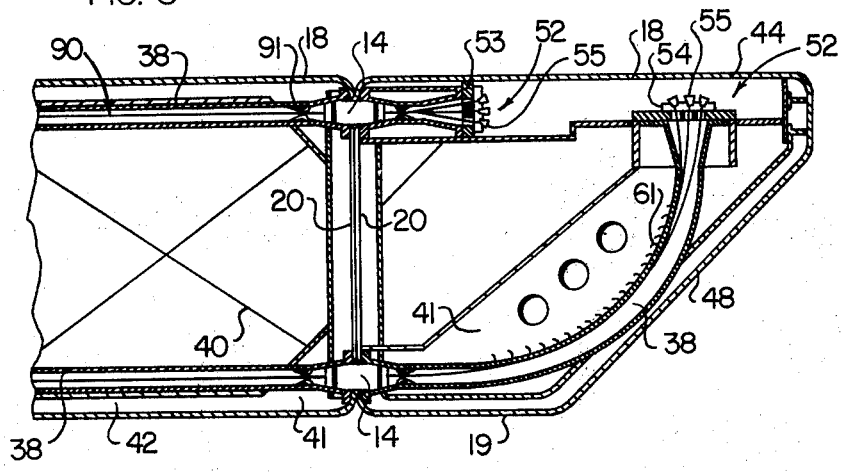
FIG. 7 is an enlarged sectional view of a corner of the barge of FIG. 1 taken along the lines 7—7 thereof, and showing the details of the tubular truss network therein.

As shown most clearly in FIGS. 4 and 7, each socket 22 is an inwardly tapering opening of a shape complementary to the general pin taper 24. Each socket is further centrally apertured through an opening 37 of a size and position so as to be in registry with the passage 26 of the alignment pin 14 in mating engagement therein. Each socket 22 is thus seen to form an infundibular opening in the walls 20—20. For obvious structural reasons, this opening is preferably formed of the same or similar material and thickness as that used in alignment pin 14. The size of the socket 22 is slightly larger than that of the mating pin 14, providing a loose fitting mating engagement. Such a loose fit is necessary to prevent binding a freezing of the pin 14 in the socket 22 and to allow a small degree of pivotal movement during assembly. Steel, cast in a conical configuration and welded to the modular wall 20, along seam 23, has been shown to be structurally effective as well as functionally providing a suitable seal to maintain the watertight configuration. This structured opening further serves as the extension of truss 38 for carrying the loads imparted therealong during and after assembly.

The truss 38 is preferably formed of a cylindrical pipe constructed of suitably strong material. Conventional connection means, such as welding, provides the necessary structural and functional watertight joint necessary in connecting the opposed sockets 22—22. As shown most clearly in FIGS. 3A and 7, the trusses 38—38 are provided in vertical pairs to connect opposed socket pairs spaced near the deck and bottom surfaces 18 and 19, respectively. This truss configuration provides maximum transverse structural support for each module 12. When a series of modules 12—12 are assembled, this transverse truss system becomes the longitudinal truss network for the barge 10. Conventional diagonal braces 40—40 as shown in FIG. 7, are preferably used to maximize torsional rigidity in this structure.

Each module 12 is a self-contained flotation unit. It is constructed to a size practical for both land and airborne transportation to an assembly site. The absence of projecting appendages, such as integrally formed connecting pins used in prior art structures, is therefore a marked advantage in this invention. The advantageous features, however, are more than skin deep. Beneath the relatively thin walls formed by surfaces 18, 19, 20 and 21, is a rib structure 41 formed of suitably strong material such as steel, in an I-beam configuration, or the like.

A typical rib structure 41, as shown in FIG. 7, provides a series of opposed reinforcements beneath each side wall 20 of each module 12. A plurality of individual ribs 42—42, of generally rectangular cross-section, spaced longitudinally equidistant within each module 12, form the rib structure 41 in position to be contiguous ribs 42—42 of an adjacent module 12 when the two are assembled in their select abutting configuration. This construction provides a plurality of generally vertical load bearing transfer planes between abutting module pairs. Such a structural arrangement minimizes the necessary thickness of the module side walls 20—20 and the overall weight of the barge 10.

Referring again to FIG. 1, it may be seen that a plurality of module configurations are generally necessary to comprise a single barge 10. For example, a moon pool 43 is necessary for drilling applications. Shorter central modules 50—50 are utilized to provide this feature, which necessitates the socket pattern shown in FIG. 3. Outwardly, elongated modules 44 having a first slanted end wall 46 and first slanted side wall 48, are provided for perimeter location because of functional attributes discussed below. Inboard modules, such as module 50 may be provided with substantially vertical side walls. It may thus be seen that each module 12 is shaped for a particular array location, which location determines the shape, size, and wall slant thereof.

One common feature of each module 12, regardless of shape, is the structural provision of ribs 41 and trusses 38—38 described above. Each inboard module is therefore provided with the sockets 22—22 on each of the side walls 20—20 thereof. The outboard or perimeter modules 44—44 are provided with sockets 22—22 upon a single inboard side wall 20. As shown in FIG. 7, the series of end-to-end trusses 38—38 terminate at tie off points 52—52 in these perimeter modules 44—44. Each tie-off point 52, as shown, includes a structural bulkhead or reaction plate 53, bowl 54 and a plurality of grippers 55—55. Tie-off points 52—52 are provided for both upper and lower trusses 38—38 near the deck surface 18 to facilitate access thereto. It may thus be seen that the lower truss 38 of the perimeter module 44 has an arcuate shape due to the outboard wall 48, and is preferably welded to the rib structure 41 along a beam 61 for structural reasons. The function of this structural feature will be discussed below.

As best illustrated in FIG. 4, an alignment pin 14 releasable secured in a socket 22 by the fastening of a latch 58 which engages the necked section 28. Latch 58 includes a cylindrical shaft 60 extending vertically through and rotatably mounted in the module 12. Shaft 60 engages to the socket 22 along a wall 62 and is further provided with an eccentric section 64 formed therealong. On opposite sides of wall 62, shaft 60 is rotatably sealed in the module 12 by conventional means (not show) to maintain the watertight configuration. In the eccentric section 64, the eccentricity is formed by a recess 66, being of sufficient depth that shaft 60 does not extend into the socket 22 when oriented in a particular rotational position. Such an orientation permits unobstructed entry and mating of the pin 14 in the socket 22. It may also be seen that a rotation of shaft 60 of 180° provides the locking effect for the pin 14 by the projection of eccentric section 64 into the socket 22 and the necked section 28.

The rotational features of the latch 58 provides both sealing and functional advantages. Rotation is easier to impart through manual effort than motion such as lifting, and the simplicity of construction renders economically feasible the adaptation of a separate latch 58 for each socket 22. This provision allows the locking of each pin 14 on an individual basis rather than in groups, as when a single latch controls a plurality of sockets 22—22. In the latter case, although only once socket 22 need be locked or unlocked, a series would need be actuated, necessitating consideration of the total effect on the barge 10. In the present embodiment, should a single pin 14 be damaged, it can be removed without effecting other sockets 22—22.

The alignment of one socket 22 to another, in vertical pairs, is preferably offset by the width of a latch 58, to provide the individuality in the latching feature. A shaft 60 thus preferably extends from the deck 18 to a lower pin-socket engagement and is set off from the upper socket wall as shown in FIG. 4. Each latch 58 then terminates on deck surface 18 in a separable, conventional rotational control device (not shown).

Figure 5:
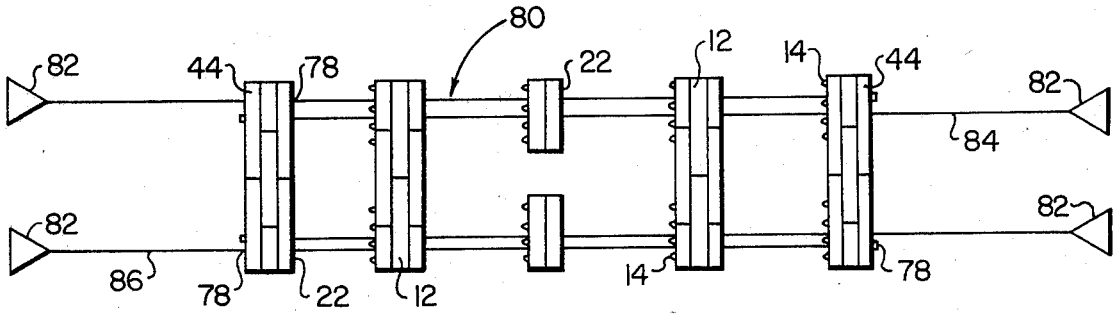
FIG. 5 is a top plan view of a modular barge in spaced array prior to the assembly thereof, showing the threaded linkage therebetween by a series of assembly filaments.
Figure 6:
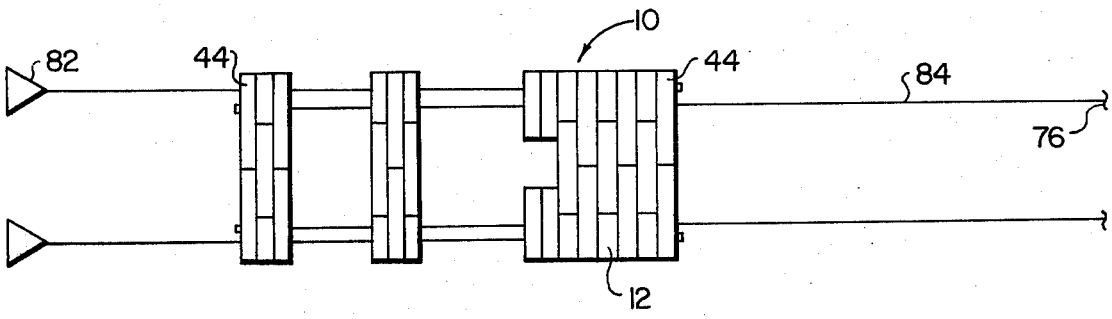
FIG. 6 is a view similar to FIG. 5 and shows a partial assembly of the modular barge array.

Referring now to FIGS. 5 and 6, assembly of the barge 10 is effected by positioning an alignment pin 14 in one of each pair of opposed sockets 22—22 for mating with the other of an adjacent module 12. The modules 12—12 are then spaced apart in an array upon a surface such as water or ice 76 for assembly. When on ice 76, the correct spacing of the array will be necessary to prevent early breakthrough of assembled portions due to weight concentration. The stress concentration will increase as the array is closed during assembly to the point where an assembled section may cause the ice to fracture.

Preliminary assembly of module sections as shown in FIG. 5, may be completed as an initial assembly step. The modules 12—12 are positioned and mechanically fastened by conventional means, end to end as required to comprise the barge width. These lengthwise modular groups may further be assembled in side by side groups to comprise subassemblies, particularly adapted for the assembly method herein defined. Such a subassembly technique is feasible when an assembly method as defined below is utilized.

Non-structural, tubular passages 78—78 are provided in each module 12 to facilitate assembly of the barge 10. Each passage 78 is preferably centrally located between the deck and bottom surfaces, 18 and 19, extending therebetween as shown in FIGS. 2, 3 and 3A, in parallel spaced relationship with the trusses 38—38. A watertight construction is likewise incorporated around the passage 78, which functions exclusively as a path for the initial threaded linkage of the various modules 12—12 of the barge 10 in the array.

Suitably strong tensioning members in the form of stranded assembly cables generally referred to as 80 are threaded through the passage 78—78 of the various modules. One end of each cable 80 is anchored in the perimeter module of the group being assembled, which in FIGS. 5 and 6, are outboard modules 44—44. The modules 44—44 are pulled toward the adjacent modules 12—12 by a suitable pulling device, such as winches, attached to the other end of the cable 80 on, or beyond, the opposite perimeter module 44.

Two sets of assembly cables are preferable. A first set of cables 84—84 are anchored in left side perimeter modules 44—44 and extending to the right, as viewed in FIG. 6, through passages 78—78, may be used to draw those modules on the left of the barge center, laterally thereto. A second set of cables 86—86 anchored in right side perimeter modules 44—44 and extending through the modules 12—12 through other passages 78—78, may be used to draw those modules on the right of the barge center, laterally thereto. In this manner a bidirectional threaded linkage is employed for assembly.

A separate passage 78 for each cable is preferable. As shown in FIGS. 2 and 5, passages 78—78 may be paired on opposite ends of each transverse module group. In this manner one set of cables may be threaded in the inside passages and the other set in the outside passages for balancing pulling forces and controlling angularity of the moving modules.

A winch, representatively shown as 82, may be positioned at the tensioning end of each of the cables, in which case at least four winches would be necessary. In such arrangement all modules may be drawn together simultaneously for assembly in the predetermined central location. Alternatively, as seen in FIG. 6, a single set of winches 82—82 may be used by anchoring, in or on surface 76, the tensioning ends of the other cables, in this case, cables 84—84, during assembly. The central assemblage feature of above is achieved by changing the winches 82—82 to the other cables when one side of the barge 10 is centrally assembled.

Separate passages 78—78 are used to carry the assembly cables 84 and 86, rather than the truss members 38—38. This preferable arrangement allows the trusses 38—38 and coaxially aligned pins 14—14 to be utilized singularly for a set of post-tensioning cables 90—90, after the array configuration is united, as will be explained in more detail below. Furthermore, the assembly cables 80 may be of lesser quality and cost and may be cut and left in place after the initial assembly is complete.

The alignment pins 14—14 locked in sockets 22—22 by latches 58—58, provide the intermediate securement of the barge assemblage between the times when the assembly cables 80 close the array and are cut and the time when the post-tensioning cables 90—90 are threaded and rendered taught. Each pin 14 thus functions as a self-aligning instrument during the initial contact of adjacent modules 12—12. Because each pin 14 is loosely fitted and non-rigidly held in each socket 22, a wide latitude of the pivotal movement necessary to align said modules, is possible. Assembly on an undulating body of water or fragile ice is thus facilitated.

During disassembly a similar function is served by the pins 14—14 with the distinct advantage that should one of said pins be deformed and/or frozen in a mating socket from which removal is desired, it can be expelled from the adjacent socket 22. Furthermore, the shape and loose fitting manner of pin-socket engagement serve to relieve shear stress imparted by bending and twisting loads inherent in such platforms during assembly and disassembly.

Once the initial assembly step is completed, the barge 10 exists in a substantially rigid condition, held together exclusively by the myriad of pin-socket-matings. Post-tensioning cables 90—90 are then threaded seriatim through the trusses 38—38 and alignment pins 14—14. As shown in FIGS. 4 and 7, frustoconical members 91 are preferably provided near, and tapering toward, the sockets 22—22 to facilitate the threading operation by serving as funnels to guide said cables therein.

Each cable 90 is preferably of the covered mullistrand variety. For oil well drilling applications for the barge 10, bridge-strand cables of 1 inch overall diameter steel have proven satisfactory. The tie-off points 52—52 for such cables include a plurality of openings in the reaction plate 53 for receiving groups of strands of cable 90, facilitating applying tension thereto and the securing thereof.

As shown most clearly in FIG. 7, the cables 90—90 are threaded and pulled through the barge 10 to the necessary magnitude of tension and secured in this taught condition. Conventional fastening means for cables, such as the grippers 54 and bowl 55 as shown, have been found satisfactory for this purpose. Adjacent side walls 20—20 of each module 12 are resultantly pressed and held firmly together, imparting structural rigidity in the barge 10 as the result of this final assembly step.

Static tension in the various cables 90—90 in the range of 50,000 to 75,000 PSI for the structure described above adopted for oil well drilling rigs, has been found satisfactory. Suitable tensioning means has been found in conventional hydraulic equipment commercially available for bridge construction.

While the tension cable path defined by upper and lower trusses 38—38 has been shown, and the tension range defined therefor, it is contemplated that other structural patterns are possible with other tension ranges. It is apparent, however, that in the present embodiment, the trusses 38—38 and rib cage 41 of each module 12 are utilized to the fullest in carrying the longitudinal compressive stresses of the barge 10 in its loaded condition.

The relatively large area of abutting contact between modules 12—12 provides for an improved capability to accommodate bending and twisting loads in the barge 10. Instead of such loads being concentrated in locking appendages or latches, they are evenly distributed across the structurally supported abutting side walls 20—20 where the shear resistance can be maximized within the strength of materials employed. In this manner, the appendages of the present invention, pins 14—14, carry minimal to zero loads in the assembled, post-tensioned structure, alleviating possible damage to this alignment and assembly element under heavy barge loading.

Figure 8:
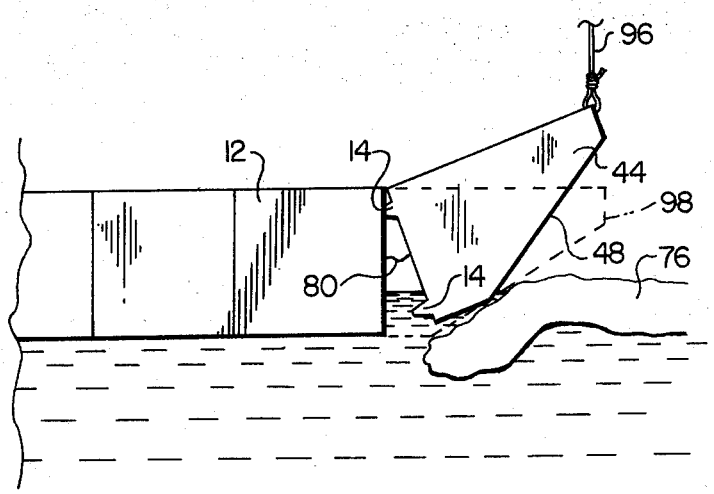
FIG. 8 is an enlarged fragmentary, side elevational view of a corner of the barge of FIG. 1 shown floating in an ice pack during disassembly.

Turning now to FIG. 8, which illustrates in what extreme condition the barge 10 may be assembled and disassembled, shown is an end module 44 being detached from the adjacent module 12 and encompassing ice pack 76 by a cable 96 attached to a crane, or the like (not shown). It may be seen that the slanted side wall 48 provides for disassembly from the ice, which, by definition, generally freezes to the module walls 20—20, rendering the barge 10 immobile and preventing the lateral movement of any of the modules 12—12, necessary for disassembly. The slanted wall 48 allows the module 44 to be pivoted around the upper pin 14 after the post-tensioning cables 90—90 are removed and both pins 14—14 disconnected. The slant angle of wall 48 is preferably such to allow this arcuate movement wholly within the lateral zone of the assembled module, shown in phantom by dashed lines 98. Thus when freed from the ice 76, the barge 10 can be disassembled without enlarging the existing "hole" in said ice.

It may also be seen from FIG. 8 that freeing the barge 10 from the ice 76 can be accomplished simply by unweighting the barge to allow the bouyant force of the water to lift it upward. If the barge 10 rises, the slanted side walls 48 will obviously break free of the contiguous ice in this situation. Unweighting can be accomplished by unloading the barge as when the drilling or other supported structure is removed. A cable 80 is shown extended in a limp condition between said modules, as is the case in disassembly.

From the foregoing it will be appreciated that the invention provides novel apparatus and methods for assembly and disassembly of a modular platform. Such apparatus and methods are peculiarly adapted for icy water regions, although providing, equally, an improved structure and assembly means therefor for less extreme offshore conditions.

Since no other assembly or diassembly apparatus is necessary other than the assembly winches, both transport and handling of the structure is simplified and more economical. Furthermore, since a proven structural technique, similar to post-tensioning used for concrete, is adapted and utilized for structural integrity, a more secure, stable and versatile construction is possible.

While various embodiments of the invention have been described herein, it is appreciated that variations and modifications are possible without departing from the spirit and scope of the invention.

What is claimed is:

1. The method of assembling a modular barge unit from a plurality of floatation modules, each having transverse passageways extending therethrough and positioned upon a surface of ice subject to breakthrough under the total barge weight concentration, which assembly is effected by elongated filaments and means for the pulling thereof, comprising the steps of:

arranging the modules in spaced array upon the ice in a predetermined spatial relationship for effecting a weight concentration less than that needed for breakthrough;

threading first and second filaments through opposed passageways of said modules for the pulling of perimeter ones thereof in opposite directions;

connecting first ends of the filaments to opposite perimeter modules of the threaded array for pulling said perimeter modules toward one another transversely of their linear dimensions;

extending second ends of the filaments outwardly through the opposite perimeter modules of the array;

connecting said second ends of the filaments to said pulling means; and pulling said first and second filaments through said modules to draw said perimeter modules and those therebetween toward one another and the center of the array, providing the breakthrough thereof in a predetermined central position inwardly of the outermost modules in the array.

2. The method as defined in claim 1 including:

threading said first and second filaments in pairs, one of each through opposite ends of each module for the pulling of said perimeter modules with controlled angularity transversely of their linear dimensions.

3. The method as defined in claim 1, wherein the step of arranging said modules includes defining as perimeter modules those opposite ones of the central array portion inwardly of the outer modules which once drawn together will produce sufficient weight concentration for breakthrough of the ice.

4. The method as defined in claim 3 and further including the step of:

assembling the perimeter modules outwardly of the central array by repeating the steps of threading, connecting, extending, connecting and pulling modules through and toward the central array.

* * * * *